US006152688A

United States Patent [19]

Staab et al.

[11] Patent Number: 6,152,688

[45] Date of Patent: Nov. 28, 2000

[54] FUEL PUMP

[75] Inventors: Matthias Staab, Alheim; Thomas Werner, Nantershausen, both of Germany

[73] Assignee: Mannesmann VDO AG, Frankfurt, Germany

[21] Appl. No.: 09/095,531

[22] Filed: Jun. 10, 1998

[30] Foreign Application Priority Data

Jun. 14, 1997 [DE] Germany ..... 197 25 249

[51] Int. Cl.[7] ..... F04D 5/00

[52] U.S. Cl. ..... 415/55.5; 415/55.1; 415/169.1

[58] Field of Search ..... 415/55.1, 55.2, 415/55.3, 55.4, 55.5, 55.6, 55.7, 169.1

[56] References Cited

U.S. PATENT DOCUMENTS 4,556,363 12/1985 Watanabe et al. .

5,364,238 11/1994 Yu ..... 415/55.1

5,401,147 3/1995 Yu ..... 415/55.1

5,580,213 12/1996 Woodward et al. ..... 415/55.1

FOREIGN PATENT DOCUMENTS 0636791 2/1995 European Pat. Off. .

*Primary Examiner*—Christopher Verdier

*Attorney, Agent, or Firm*—Martin A. Farber

[57] ABSTRACT

A fuel pump is developed as a side-channel pump with two conveyor chambers for the conveying of a liquid to an outlet channel, and has two inlet channels arranged one behind the other seen in the direction of flow. One of the inlet channels debouches into a radially inwardly arranged partial-ring-shaped channel, while the other inlet channel is connected to a radially outwardly arranged partial-ring-shaped channel. In this way, the pressure within the liquid to be conveyed is increased stepwise and, thus, gas bubbles produced by a vaporization of the liquid are avoided.

8 Claims, 3 Drawing Sheets

FUEL PUMP

FIELD AND BACKGROUND OF THE INVENTION

The present invention relates to a fuel pump having a driven propeller, or impeller wheel, rotatable in a pump housing and in which, in at least one of its end sides, there is arranged a ring of guide vanes defining vane chambers, having a partial-ring-shaped channel arranged in the pump housing in the region of the guide vanes, which channel together with the vane chambers forms a conveyor chamber for conveying a liquid from an inlet channel to an outlet channel.

Such fuel pumps are known as peripheral or lateral channel pumps and are used, for instance, for conveying fuel or wash liquid of a windshield-cleaning system of a motor vehicle. In this case, the guide vanes in the conveyor chamber produce a circulatory flow which extends transverse to the direction of movement of the guide vanes. The fuel pump is characterized by a particularly small need for maintenance. Furthermore, very high conveyor pressures can be produced by the fuel pump. With such a fuel pump, however, readily volatile liquids upon flow into the conveyor chambers, such as, for instance, fuel of solvents of a wash liquid can evaporate and thus form gas bubbles. The gas bubbles are therefore produced more frequently the higher the temperature of the liquid and the lower the pressure in the inlet channel. The gas bubbles lead to a strong reduction in the delivery capacity of the fuel pump. Furthermore, the gas bubbles produce cavitation at the pump housing. This cavitation leads in the long run to a destruction of the wall of the partial-ring-shaped channel and then to a reduced delivery of the fuel pump.

A fuel pump known in practice has several pump stages with a plurality of impeller wheels. In this way, the pressure increase in the fuel pump could take place stepwise, so that a vaporization of the liquid is avoided.

This fuel pump, however, has the disadvantage that several impeller wheels for the production of several pump stages result in a considerable structural expense. The fuel pump in this way consists of a very large number of structural parts which must be aligned to each other expensively and mounted.

SUMMARY OF THE INVENTION

It is an object of the invention so to develop a fuel pump of the aforementioned type that it substantially prevents evaporation of the fuel and can be produced as economically as possible.

According to the invention, the fuel pump has at least two inlet channels (8, 9) arranged one behind the other seen in the direction of flow.

By this development the liquid to be conveyed is first of all divided over the inlet channels and then passes to different points in the fuel chamber. In this way, the part of the liquid flowing through the first inlet channel first of all experiences an increase in pressure and is then mixed with the liquid entering the fuel chamber through the second inlet channel. Therefore a strong vacuum is avoided in the region of the inlet channels and thus the danger of an evaporation of the liquid is considerably reduced as compared with a fuel pump having a single inlet channel. The fuel pump of the invention requires only a single impeller wheel and thus consists of very few structural parts. In this way the fuel pump of the invention can be produced particularly inexpensively.

Frequently, a fuel pump in which conveyor chambers are arranged on both sides of the impeller wheel is used in a fuel tank of a modern motor vehicle, the conveyor chambers communicating with the flow of the liquid from the one conveyor chamber into the other conveyor chamber. The fuel pump of the invention is traversed axially and therefore has particularly small dimensions when the inlet channels (8, 9) are arranged in a first inlet-side housing part (3) of the pump housing and the outlet channel (13) is arranged in an outlet-side housing part (4) which is arranged opposite the inlet-side housing part (3). By this development, the fuel pump can be fastened in a conveyor unit for a fuel tank without expensive laying of lines.

The length of the partial-ring-shaped channel or of the partial-ring-shaped channels determines the diameter of the impeller wheel and thus the radial dimensions of the fuel pump. The fuel pump of the invention has particularly small radial dimensions if, at least one of the housing parts (3) has two concentrically surrounding partial-ring-shaped channels (10, 11) a nd the impeller wheel (7) has two correspondingly arranged rings of vane chambers (15, 16).

One might consider connecting several inlet channels with the radial inner partial-ring-shaped channel. The number of inlet channels can, in accordance with another advantageous further development of the invention, be particularly small if one of the inlet channels (9) discharges into the radially inner partial-ring-shaped channel (11) and a second inlet channel (8) discharges into the outer partial-ring-shaped channel (10), and the radially inner partial-ring-shaped channel (11) is connected with the radially outer partial-ring-shaped channel (12). In this way, the fuel pump of the invention can be produced particularly inexpensively.

The connection of the radially inner partial-ring-shaped channel with the other partial-ring-shaped channel is particularly simple structurally in accordance with another advantageous further development of the invention if the radially inner, partial-ring-shaped channel (11) is connected with the radially outer, partial-ring-shaped channel (12) via an overflow channel (14) of groove shape worked into one of the housing parts (4) of the fuel pump (2). By this development the housing parts of the fuel pump can be produced inexpensively, for instance in an axially deformable sinter mold.

Tests have shown that in the case of axially traversed fuel pumps, gas bubbles are very frequently produced on the side opposite the inlet channel. Gas bubbles on the side opposite the inlet channel of the outer partial-ring-shaped channel can in accordance with another preferred further development of the invention be easily avoided if the overflow channel (14) is worked into the outlet-side housing part (4) and the radially inner ring of the vane chambers (16) passes axially through the impeller wheel (7). By this development, the liquid in the part of the intake side conveyor chamber having the radially inner partial-ring-shaped channel first of all experiences an increase in pressure. Thereupon, the liquid is conducted via the overflow channel to the outlet side partial-ring-shaped channel on the side opposite the second inlet channel. By a suitable selection of the size of the radially inner partial-ring-shaped channel and of the overflow channel, almost any pressure can be produced on the side opposite the second inlet channel. In this way, the production of gas bubbles is dependably avoided at this place.

Eddyings in the case of several inlet channels discharging into a single partial-ring-shaped channel can be avoided in simple manner in accordance with another advantageous further development of the invention, if the partial-ring-shaped channels (10, 11) have in each case an expansion in cross section at each of the inlet channels (8, 9). In this way, the circulation of flow is developed in the direction of flow seen behind the first inlet channel. Thereupon the liquid flowing through the next inlet channel is carried along by the circulation flow and entrained uniformly with it.

Frequently, upon the impacting of the liquid on the side vanes, eddyings occur which lead to the production of gas bubbles. Eddies produced upon the impinging of the liquid on the guide vanes can be avoided in simple manner in accordance with another advantageous further development of the invention if in each case a guide element (23) for the tangential feeding of the liquid into the partial-ring-shaped channel (10) is arranged in the inlet channels (8). In this way, the liquid to be conveyed passes first of all into the partial-ring-shaped channel and is thereupon taken up by the circulatory flow.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
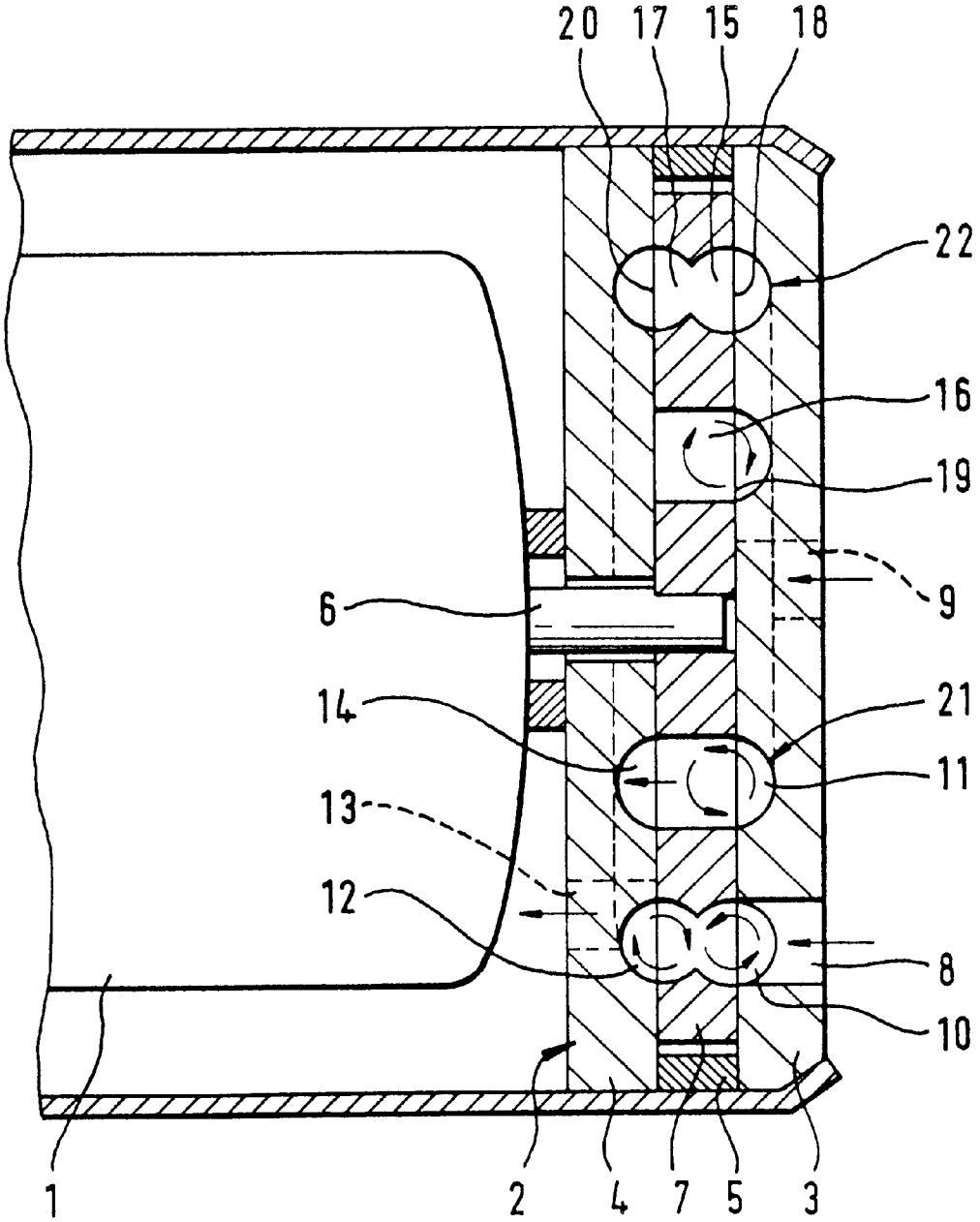
FIG. 1 is a diagrammatic showing of a fuel pump according to the invention, seen in longitudinal section.

FIG. 1 shows a fuel pump 2 in accordance with the invention driven by an electric motor 1 and developed as side channel pump, having an inlet-side housing part 3 and an outlet-side housing part 4. The housing parts 3, 4 are braced against an annular spacer 5. Between the housing parts 3, 4 an impeller wheel 7 fastened on a shaft 6 of the electric motor 1 is rotatable. The inlet-side housing part 3 has two inlet channels 8, 9, which discharge respectively into partial-ring-shaped channels 10, 11. The two partial-ring-shaped channels 10, 11 are arranged concentrically with respect to each other. The outlet-side housing part 4 has a single partial-ring-shaped channel 12 which discharges into an outlet channel 13. The partial-ring-shaped channel 12 of the outlet side housing part 4 is connected with an overflow channel 14 which is conducted up to the region of the radially inner partial-ring-shaped channel 11 of the inlet-side housing part 3. Upon rotation of the impeller wheel 7, a liquid which is to be conveyed is conveyed from the two inlet channels 8, 9 to the outlet channel 13. The fuel pumnp 2 is in this connection traversed axially.

Guide vanes 18–20 defining rings of vane chambers 15–17 in each case in the region of the partial-ring-shaped channels 10–12 are worked into the end sides of the inmpeller wheel 7. Vane chambers 15, 17 which lie facing each other are arranged in the region of the radially outer partial-ring-shaped channels 10, 12. The vane chambers 16 arranged in the radially inner partial-ring-shaped channel 11 pass through the impeller wheel 7.

Figure 2:
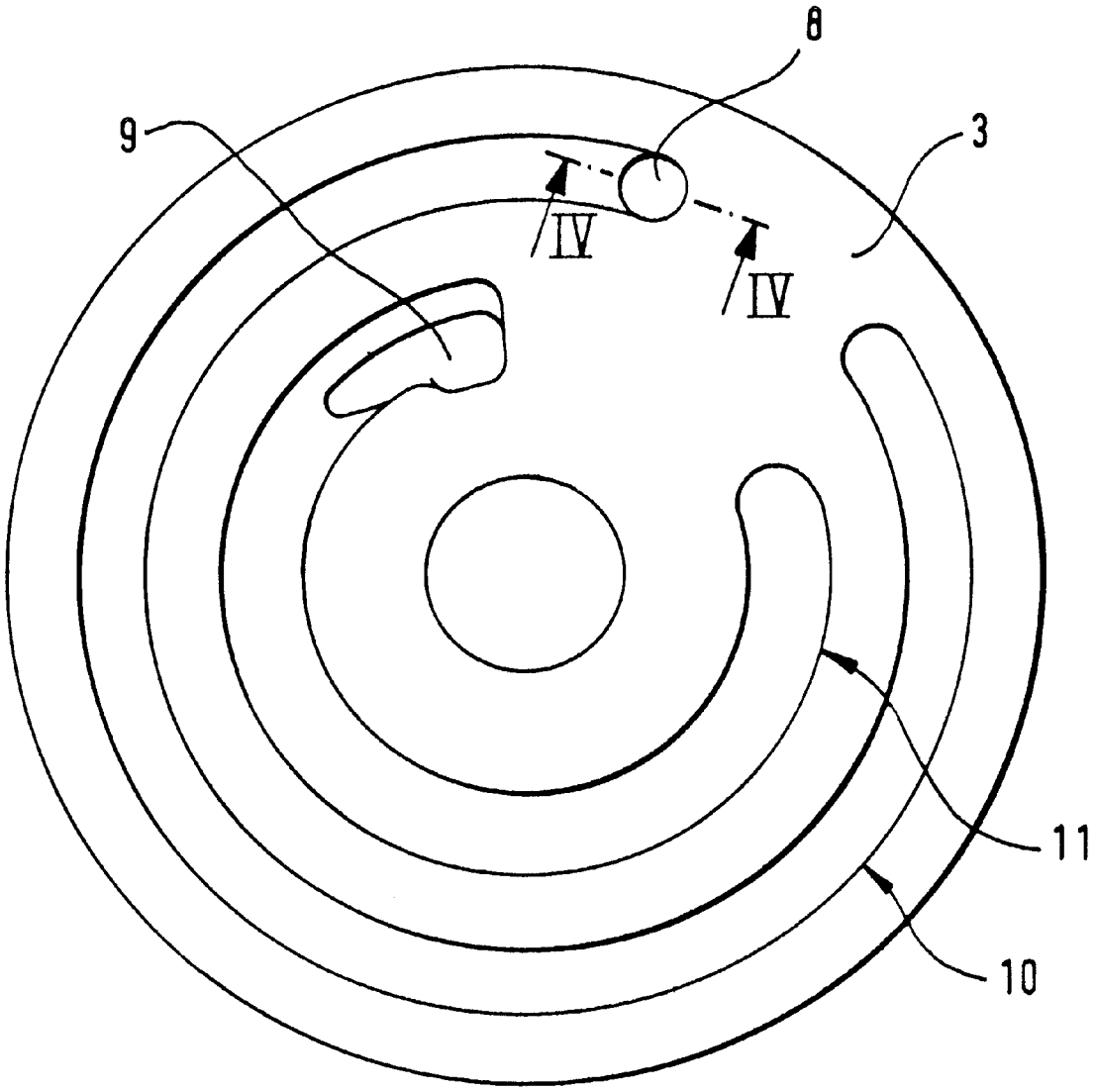
FIG. 2 shows an inlet-side housing part of a pump housing according to FIG. 1.

The inlet-side housing part 3 of FIG. 1 is shown in an elevation of the impeller wheel 7 in FIG. 2. The radially outer partial-ring-shaped channel 10 and the inner partial-ring-shaped channel 11 extend in this connection over an angular range of about 270° to 320°. The inlet channels 8, 9 are arranged in each case at one end of the partial-ring-shaped channels 10, 11.

Figure 3:
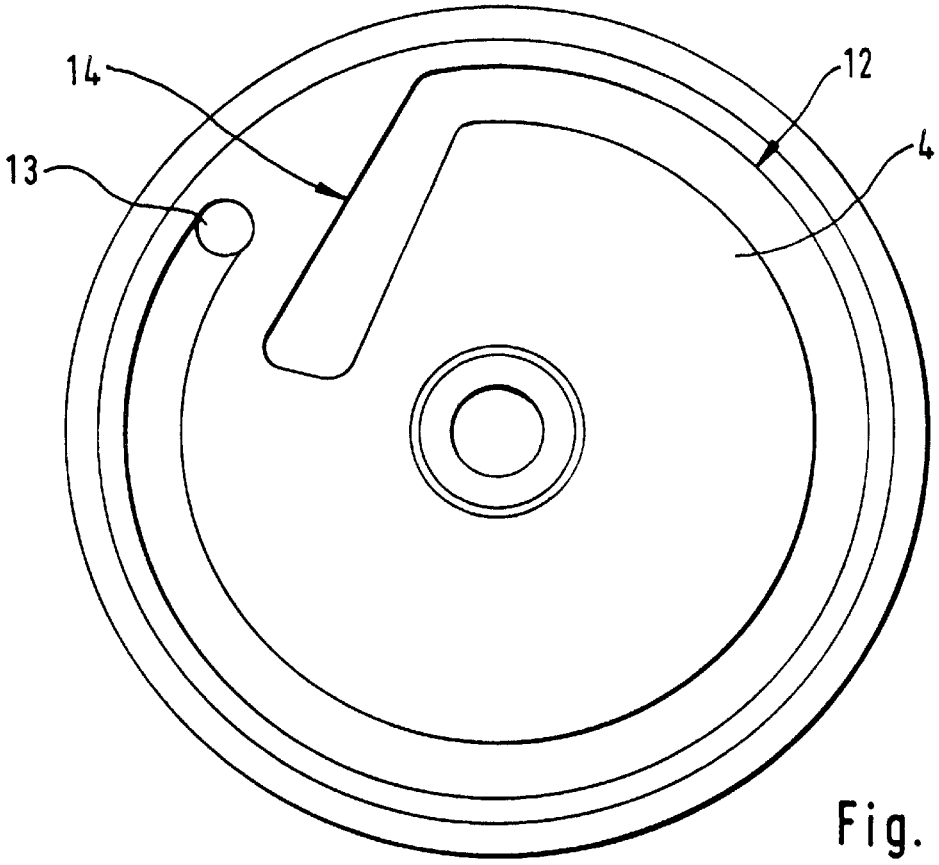
FIG. 3 shows an outlet-side housing part of a pump housing according to FIG. 1.

FIG. 3 shows the outlet-side housing part 4 of FIG. 1 of the impeller wheel 7. The partial-ring-shaped channel 12 debouches into the outlet channel 13. At its end facing away from the outlet channel 13, the partial-ring-shaped channel 12 is connected with the overflow channel 14 shaped in the form of a groove.

The fuel pump shown in FIG. 1 thus has a delivery chamber 21 for the feeding of the liquid which extends from the inlet channel 9 debouching into the radially inner partial-ring-shaped channel 11 up to the outlet channel 13.

A second delivery chamber 22 extends from the inlet channel 8 debouching into the radially outward partial-ring-shaped channel 10 up to the end of the radially outer partial-ring-shaped channel 10 of the inlet-side housing part 3. The overflow channel 14 shown in FIG. 3 terminates on the side of the impeller wheel 7 lying opposite the inlet channel 8 of the radially outer partial-ring-shaped channel 10.

Upon a rotation of the impeller wheel 7, circulation flows of the liquid to be conveyed are produced in the conveyor chambers 21, 22. For clarification, the flows within the fuel pump 2 are designated by arrows. By the connection to each other of vane chambers 15, 17 lying opposite to each other, the liquid to be conveyed can flow approximately free of eddy from the one conveyor chamber 22 into the other conveyor chamber 21. In front of the end of the radially inner partial-ring-shaped channel 11, the flow is conducted by the impeller wheel 7 to the start of the overflow channel 14. In this way, the pressure in the liquid to be conveyed in this conveyor chamber 21 is increased stepwise and eddying and strong differences in pressure within the liquid are thus avoided. Pressure differences, particularly in the case of readily volatile liquids lead to their vaporization and thus to gas bubbles which reduce the capacity of the fuel pump 2. Such gas bubbles are produced, in particular when the fuel pump 2 is used as fuel pump in a fuel tank of a motor vehicle, and the fuel is of high temperature.

Figure 4:
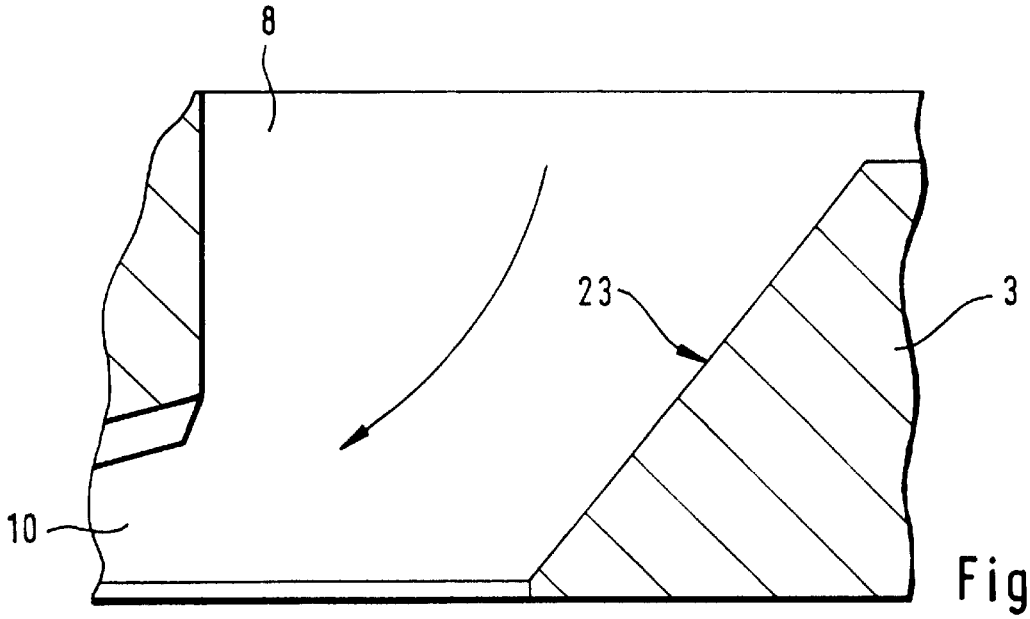
FIG. 4 is a section through an inlet channel of the housing part according to FIG. 2, along the line IV—IV.

FIG. 4 shows one of the inlet channels 8 of FIG. 2 in a sectional showing along the line IV—IV. Within the inlet channel 8, a guide element 23 for the tangential feeding of the incoming liquid into the partial-ring-shaped channel 10 is arranged. In this way, an axial impingement of the liquid on the guide vanes 18 of the impeller wheel 7 shown in FIG. 1 is avoided.

We claim:

1. A fuel pump comprising:

plural inlet channels and an outlet channel, a pump housing and a driven impeller wheel rotatable in the pump housing, and plural rings of guide vanes defining vane chambers and being arranged in an end side of the impeller wheel, a liquid received by the pump being divided among the plural inlet channels;

plural partial-ring-shaped channels disposed in the pump housing in the vicinity of the guide vanes, the respective ring-shaped channels together with the respective vane chambers forming respective conveyor chambers for conveying the liquid from said inlet channels to said outlet channel; and wherein said plural inlet channels communicate with respective ones of the partial-ring-shaped channels and are arranged one behind the other as seen in a direction of flow of the liquid through the pump.

2. A fuel pump according to claim 1, in which said conveyor chambers are arranged on both sides of said impeller wheel for communicating a flow of the liquid between said conveyor chambers, wherein said inlet channels are arranged in a first inlet-side housing part of the pump housing and said outlet channel is arranged in an outlet-side housing part of the pump located opposite the inlet-side housing part;

there is a radially inner one of said partial-ring-shaped channels and a radially outer one of said partial-ring-shaped channels disposed on an inlet side of said impeller wheel, and on an outlet side of said impeller wheel, there is a radially outer partial-ring-shaped channel disposed opposite said outer ring-shaped channel of said inlet side and having a segment extending as an overflow channel to a location opposite said inner partial-ring-shaped channel of said inlet side;

there is a radially outer fluid communication region in said impeller wheel and a radially inner fluid communication region in said impeller wheel, an outer one of said inlet channels connects with the radially outer one of said partial-ring-shaped channels on said inlet side, an inner one of said inlet channels connects with the radially inner one of said partial-ring-shaped channels on said inlet side, and said outlet channel connects with said radially outer partial-ring-shaped channel of said outlet side; and liquid from said inner inlet channel communicates via said inner fluid communication region of said impeller wheel to be driven via said impeller wheel via said segment of said partial-ring-shaped channel on said outlet side of said impeller wheel to exit via said outlet channel, and liquid from said outer inlet channel communicates via said outer fluid communication region of said impeller wheel into said outer partial-ring-shared channel of said outlet side of said impeller wheel to exit via said outlet channel, thereby enabling a confluence of two pumped inlet streams of liquid into a common exit stream of liquid.

3. A fuel pump according to claim 2, wherein at least one of said housing parts has two of said concentrically surrounding partial-ring-shaped channels arranged correspondingly to two of said rings of the vane chambers on said impeller wheel.

4. A fuel pump according to claim 3, wherein one of said inlet channels discharges into the radially inner one of said partial-ring-shaped channels and a second of said inlet channels discharges into the outer one of said partial-ring-shaped channels, and the radially-inner-partial-ring-shaped channel is connected with the radially-outer partial-ring-shaped channel.

5. A fuel pump according to claim 4, wherein the connection of said radially-inner partial-ring-shaped channel with said radially-outer partial-ring-shaped channel is via the overflow channel which is groove shaped and extends into one of said housing parts of the fuel pump.

6. A fuel pump according to claim 5, wherein said overflow channel extends into said outlet-side housing part, and said radially-inner ring of the vane chambers passes axially through said impeller wheel.

7. A fuel pump according to claim 1, wherein each of said partial-ring-shaped channels has an expansion in cross section facing a respective one of said inlet channels.

8. A fuel pump according to claim 7, further comprising respective guide elements for a tangential feeding of the liquid into respective ones of said partial-ring-shaped channels, and being arranged in respective ones of said inlet channels.

* * * * *